United States Patent [19]

Musacchia

[11] Patent Number: 4,621,817

[45] Date of Patent: Nov. 11, 1986

[54] BROADHEAD ARROW WITH AXIAL ALIGNMENT DEVICE

[76] Inventor: John Musacchia, 3705 SW. 42nd Pl., Gainesville, Fla. 32801

[21] Appl. No.: 807,598

[22] Filed: Dec. 11, 1985

[51] Int. Cl.[4] ..... F41B 5/02

[52] U.S. Cl. ..... 273/421; 273/416; 403/86

[58] Field of Search ..... 273/416,419–422; 403/86

[56] References Cited

U.S. PATENT DOCUMENTS

| | | | |
|---|---|---|---|
| 272,701 | 2/1883 | Johnson | 403/86 X |
| 2,289,284 | 7/1942 | Chandler | 273/422 |
| 4,169,597 | 10/1979 | Maleski | 273/422 |
| 4,210,330 | 7/1980 | Kosbab | 273/422 |

OTHER PUBLICATIONS

Archery, 4–1978, p. 14, "Snuggers".

*Primary Examiner*—Paul E. Shapiro
*Attorney, Agent, or Firm*—Anthony A. O'Brien

[57] ABSTRACT

An archery arrow includes an arrowhead removably attachable to a shaft with an alignment member disposed therebetween. The alignment member comprises a washer-like element having opposite faces disposed in divergent planes. By rotating the alignment member prior to tightening the arrowhead to the shaft, the axial disposition of the arrowhead relative the shaft may be altered to obtain a balanced arrow free of any wobble when spin tested about the point of the arrowhead.

13 Claims, 6 Drawing Figures

BROADHEAD ARROW WITH AXIAL ALIGNMENT DEVICE

BACKGROUND OF THE INVENTION

This invention relates generally to archery arrows and more particularly to an improved arrow provided with adjustable means allowing for true axial alignment of a broadhead-equipped arrow.

During the flight of an arrow, any misalignment between the arrowhead and arrow shaft manifests itself during the spinning of the arrow in such a manner as to produce an untrue flight thereof. This problem is particularly apparent with arrows employing a broadhead, due to the substantial mass thereof as opposed to the substantially smaller and lighter mass of a target point. Broadheads are usually removably attachable to the forward end of an arrow shaft in order to provide the user with the option of selecting an appropriate broadhead for the intended game and also to allow replacement of damaged broadhead blades. In view of the large selection of broadheads available for use with any single arrow shaft, the likelihood of misalignment is heightened, since the size, shape and balance most certainly will vary between different arrowheads. As is well known in the art, certain broadheads are provided with either one or more replaceable blade elements or with one or more blade elements which may be adjustably attached to the arrowhead hub or ferrule. In such instances, when replacing or adjusting these blades, again the possibility of misalignment occurs.

With the present invention, an improved arrangement is provided wherein a relatively thin, cam-faced, washer-like alignment member is adapted to be supported about the rearwardly extending mounting stud of an arrowhead with this member capable of being angularly adjusted to alter the axial alignment of an attached arrowhead with respect to the shaft. The angular adjustment is achieved in view of the cam or tapered construction of the alignment member when viewed in side elevation.

Replaceable washer elements on aerial projectiles are generally well known and examples will be found in U.S. Pat. No. 3,957,271 issued May 18, 1976 to Kurtz et al, relating to a dart and U.S. Pat. No. 4,210,330 issued July 1, 1980 to Kosbab, and directed to a broadhead arrowhead. In the former patent, a variable number and sizes of washers are adapted to be axially aligned intermediate the body and head of the dart for the purpose of selectively regulating the overall weight and length characteristics while in the latter patent, a bladed broadhead arrow is disclosed including a plurality of removably blade members the angular disposition of which may be modified through the use of a conical or tapered washer member.

With the use of the instant alignment device, the axial disposition of any of numerous types of broadhead arrowheads may be manipulated with respect to the longitudinal axis of an arrow shaft by a simple action. By slightly loosening the arrowhead from its attachment to the shaft and by rotating a single member having opposite faces which are slightly tapered with respect to one another, subsequent tightening of the arrowhead to the shaft sandwiches the washer member therebetween and alters the disposition of the axis of the arrowhead with respect to the arrow shaft axis. Testing of the balance or alignment of any broadhead arrow is accomplished merely by spinning the arrow between the hands and on its point whereupon any evidence of misalignment between the head and shaft of the arrow will be immediately apparent by a wobbling of the arrow. With the present device, a simple radial displacement of the alignment member alters the relative alignment between the shaft and arrowhead axes to rectify any misalignment therebetween.

Accordingly, one of the objects of the present invention is to provide an improved broadhead arrow with an axial alignment device including a washer-like member having non-parallel first and second cam faces and which is disposed intermediate the arrowhead and arrow shaft.

Another object of the present invention is to provide an improved broadhead arrow with an axial alignment device including an arrow shaft provided with a threaded forward insert for receiving a broadhead mounting stud with an angularly displaceable tapered washer therebetween having indicia thereon selectively displaced with respect to indicia on the forward portion of the arrow shaft.

A further object of the present invention is to provide an improved broadhead arrow and with axial alignment device comprising an angularly displaceable split lock washer having non-parallel first and second faces and disposed intermediate the forward end of an arrow shaft and an arrowhead.

These and other objects in view which will more readily appear as the nature of the invention is better understood, the invention consists of the novel construction, combination and arrangement of parts hereinafter more fully described, illustrated and claimed with reference being made to the attached drawing.

BRIEF DESCRIPTION OF THE DRAWING

Similar reference characters designate corresponding parts throughout the several figures of the drawing.

DESCRIPTION OF THE PREFERRED EMBODIMENTS

Figure 1:
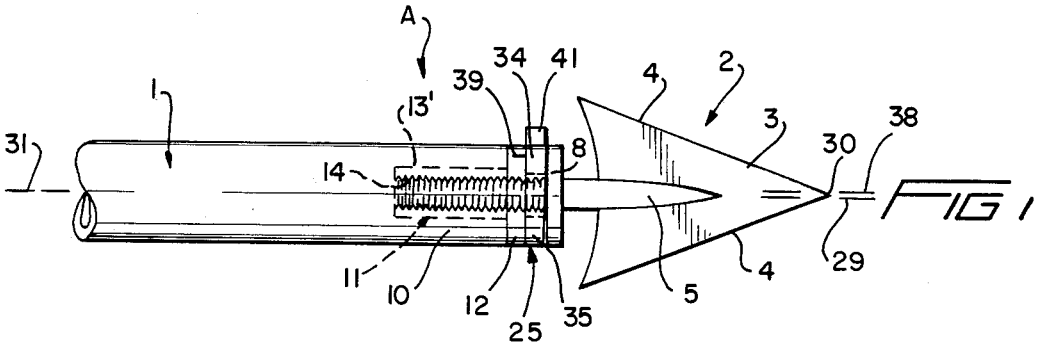
FIG. 1 is a partial side elevation of an arrow according to the present invention.
Figure 2:
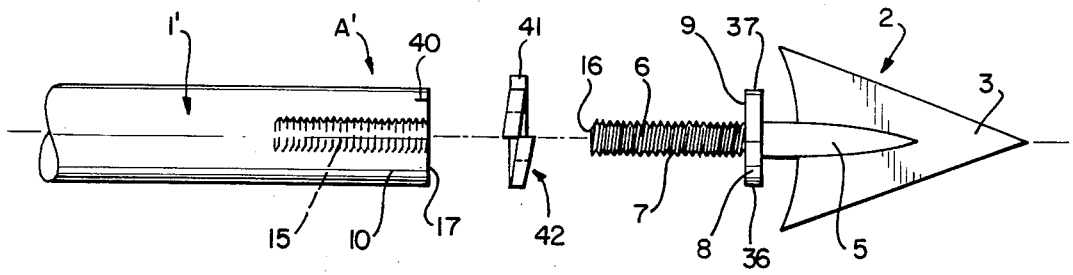
FIG. 2 is an exploded view illustrating an embodiment of the alignment device as used with a solid arrow shaft.
Figure 3:
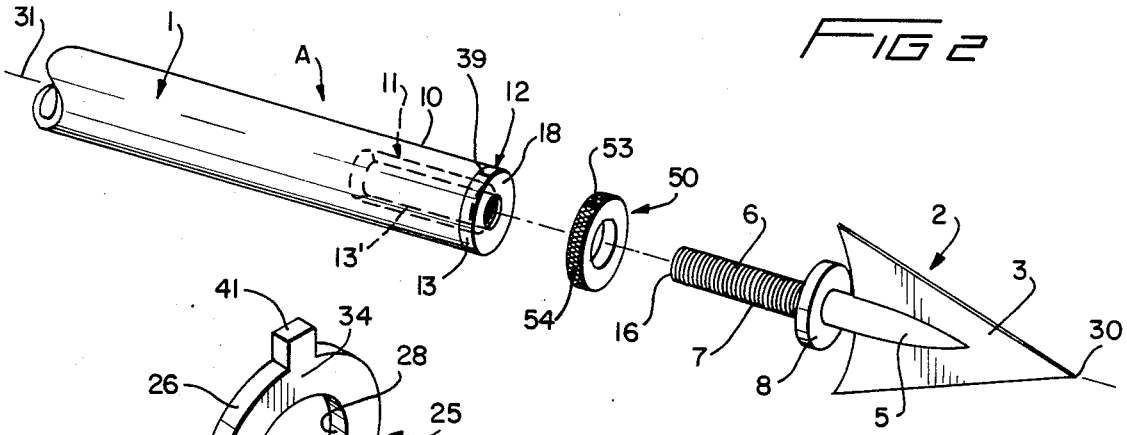
FIG. 3 is an exploded perspective view illustrating a further embodiment of the alignment member.

Referring now to the drawing, particularly FIGS. 1–3, the present invention will be seen to relate to an arrow, generally designated A or A′ comprising an arrow shaft 1 or 1′ adapted to removably support an arrowhead 2. Any suitable well-known fletching (not shown) may be included adjacent the non-illustrated end of the shafts. In the case of the arrow A of FIGS. 1 and 3, the shaft 1 is illustrated as a tubular or hollow member while the shaft 1′ of FIG. 2 comprises solid stock. It will be understood that this specific construction of the arrow shaft itself may assume any of various well known forms. For example, not only may the shaft be solid or tubular, but the material of its construction may be selected from any well known category such as metal, wood, plastics or fiber reinforced plastics. Likewise, the specific type of broadhead arrowhead 2 may quite obviously vary. The arrowhead illustrated in the drawing is shown with a single forwardmost blade 3 provided with a pair of diverging edges 4—4 and is suitably affixed to a central, rearwardly extending ferrule or hub 5. Any other suitable broadhead as is well known in the art may be employed in combination with the present invention such as the popular twin or multiple bladed broadheads including a plurality of removably or interlocked blades (not shown).

The hub 5 of the arrowhead 2 extends rearwardly from the blade 3 to provide an axially extending rearmost mounting stud 6 preferably provided with external threads 7. Located intermediate the threaded portion of the stud 6 and the hub 5 and blade 3 is a transversely extending hub plate stop or abutment 8 having a rear face 9, the plane of which is disposed normal to the longitudinal axis of the stud 6.

The means for the removable attachment of the arrowhead 2 to the foward portion 10 of a selected arrow shaft will depend upon the construction of that shaft. In the case of a tubular shaft, or even a solid shaft constructed of wood, it is desirable to provide connection means in the form of an insert, generally designated 11, in the shaft. This insert includes a circular head 12 having an outer periphery 13 similar in diameter to that of the adjacent arrow shaft and from which rearwardly extends an axial shank 13' having a bore provided with internal threads 14. The entire insert 11 may be affixed as shown in FIGS. 1 and 3 of the drawing by any appropriate means such as a press fit or adhesive, in order to insure an integral relationship with respect to the forward portion 10 of the arrow shaft. It is not necessary to provide a precision formation of the mating external threads 7 of the arrowhead stud and the cooperating threads 14 of the insert 11 since a nominal amount of looseness in the fit between these two members will actually be preferred for reasons which will become obvious hereinafter.

In the case of the solid arrow shaft 1', the insert 11 may be omitted with a threaded bore 15 being formed within the material of the shaft itself to provide suitable arrowhead connection means. The description of the arrowhead and shaft up to this point is generally along the lines of conventional construction. Existing arrows of this type are assembled simply by inserting the rear 16 of the arrowhead stud 6 into the threaded bore in the forward portion 10 of the applicable shaft following which the assembly is completed by rotating the arrowhead relative the shaft until the rear face 9 of the arrowhead stop 8 abuts the front face 17 of the shaft 1' or front face 18 of the insert 11, respectively.

Figure 4:
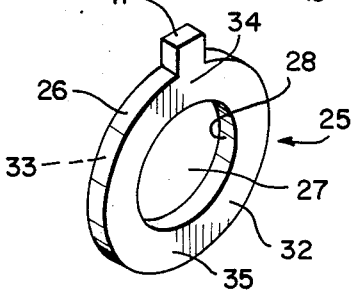
FIGS. 4–6 are perspective views illustrating various modifications of the alignment member.

The chances are, upon spin testing a conventionally constructed arrow not incorporating the alignment member of the present invention, a decided wobble will be evident thus indicating a detrimental misalignment between the arrowhead and shaft. To obivate this problem, it is proposed to include an alignment member adapted to be located intermediate the arrowhead hub plate rear face 9 and the forwardmost portion of the arrow shaft such as shown in FIGS. 1–3 of the drawing. One form of alignment member is most clearly illustrated in FIG. 4 and in an assembled position in FIG. 1. This alignment member 25 will be seen to comprise a washer-like element having a cylindrical external periphery 26 and a central bore 27 defining an internal periphery 28. The diameter of the internal perphery 28 is selected to provided a close sliding fit about the external thread 7 of the arrowhead mounting stud 6 while the external periphery 26 of the alignment member preferably defines a diameter equal to that of the forward portion 10 of the arrow shaft as well as the hub plate or stop 8 of the arrowhead. The function of the alignment member 25 is to alter the longitudinal axis 29 passing through the point 30 of the arrowhead so that this axis is aligned with the central longitudinal axis 31 passing through the adjacent arrow shaft. Exact alignment between the axes 29 and 31 in some instances may not insure passing the spin text for a wobble-free arrow, if for example, an arrowhead blade itself is out-of-balance. But in any case, by adjustment of the present alignment member, a balanced condition may be achieved such that a wobble-free arrow is obtained.

FIG. 1 of the drawing illustrates the arrow A with the alignment member 25 so positioned such that the preceeding described alignment is achieved. This relationship is accomplished in view of the specific configuration of the alignment member 25 which will be understood to include a first cam face 32 and an opposite second cam face 33, each of which respectfully comprises a planar surface while most importantly, these two surfaces are disposed in non-parallel planes. In other words, the faces 32 and 33 are inclined or tapered with respect to one another so as to provide, in one area, a thick axial portion 34 which will be understood to be diametrically opposed to a thin axial portion 35. The degree of this difference in thickness between the two diametrically opposed portions of the alignment member may be considered to be exaggerated in the illustration of FIG. 1 for purposes of clearly illustrating the aforesaid non-parallel relationship. In practice, a mere 0.005 inch difference may be provided between the thickness of the two portions 34 and 35 in order for the alignment member to satisfactorily perform its function under practically all conditions.

Using the example of FIG. 1, if the alignment member 25 were rotated 180 degrees such that the thickest axial portion 34 were at the bottom of the view and the thin portion 35 were at the top, it will follow that the bottom 36 of the arrowhead hub plate or stop 8 would be forwardly displaced while additional clearance would be provided to the rear of the top 37 of this hub plate with the result that when the arrowhead 2 is tightened or fully assembled as in FIG. 1, the point 30 thereof would be radially displaced upwardly such that the longitudinal axis 29 of the arrowhead would appear as indicated by the line 38. The foregoing describes the two extremes of adjustment available by manipulating the alignment member 25 180 degrees. In practice, a true or properly aligned arrow A or A' is achieved by spin testing same on its point 30 as previously described and by making small incremental arcuate displacements of the alignment member until a wobble-free spin test occurs.

To facilitate the manipulation of the alignment member during such incremental adjustments, it is preferable to provide an indica or reference point 39 immediately adjacent the alignment member. In the case of an arrow shaft provided with an insert 11, reference means may be provided by the formation of the indicia 39 upon the periphery 13 thereof while in the case of a solid arrow shaft 1', the reference means may comprise an indica 40 formed directly upon the periphery of the arrow shaft forward portion 10 as shown in FIG. 2. Cooperating with the relatively fixed reference means comprising the indicia 39 or 40 on the arrow shaft, is a reference means on the angularly displaceable alignment member 25 itself. In the embodiment shown in FIGS. 1 and 4, this latter reference means comprises a radially extending tab 41 which serves not only as a movable reference means but also as finger engagement means radially extending beyond the periphery of the arrowhead hub plate 8 as well as the forward portion of the arrow shaft.

Figure 5:
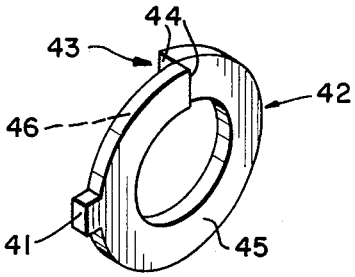

In the embodiment of FIGS. 2 and 5, an alternate alignment member 42 is shown which actually comprises a modification of the first described alignment member 25. In this latter device, the alignment member 42 is cut radially through its body at one point to provide a split 43 defined by the two offset end faces 44—44 so that a lock washer is formed. The first and second cam faces 45–46 of this latter alignment member are similarly inclined or tapered as in the device 25 and the member 42 is utilized in the same manner as the first described embodiment, with the additional feature of a built-in self-locking member being provided. This obviates the necessity of utilizing a separate conventional split lock washer to more positively retain any adjustment made by angularly displacing the alignment member 42.

All embodiments of the disclosed alignment member may be constructed of any suitable material such as metal, rubber or plastics. In the case of the alignment member 42, obviously the selected material must exhibit a degree of resilience in order for the lock washer feature to properly function.

Figure 6:
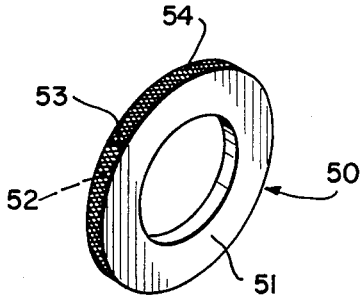

An additional modification is shown in FIGS. 3 and 6 of the drawing wherein an alignment member 50 is disclosed comprising a washer-like element as in the alignment member 25 but without any radially projecting tab 41. In the alignment member 50, the first cam face 51 and second cam face 52 again each comprise a planar surface respectively inclined or tapered as in the first described embodiment and appropriate reference means may comprise an indicia or score line 53 formed on the external periphery 54 thereof. It will be noted that this external periphery 54 is knurled or otherwise roughened to facilitate grasping and angularly displacing the alignment member while making adjustments thereof. Additionally, this periphery 54 may define a diameter just slightly larger than that of the adjacent arrowhead hub plate 8 and forward portion 10 of the arrow shaft to offer a more positive grasping thereof during its angular adjustment.

In all disclosed embodiments, it will be appreciated that a unique alignment device is provided wherein angular manipulation of a cam member provides attainment of proper alignment between the arrowhead and shaft by pivotally displacing the longitudinal axis of the arrowhead relative the shaft longitudinal axis to achieve a wobble-free arrow.

I claim:

1. An arrow including, a shaft provided with a longitudinally extending axis and having a forward portion at one end, an arrowhead provided with a longitudinally extending axis and having a blade and a rearwardly axially extending mounting stud removably attachable to said shaft forward portion, connection means within said shaft forward portion adapted to receive said arrowhead stud, said stud when engaging said shaft connection means allowing of limited radial displacement of said arrowhead relative the longitudinal axis of said shaft, an alignment member having cam means and substantially surrounding said arrowhead stud intermediate said blade and said shaft forward portion whereby, radial displacement of said alignment member alters the relative disposition between said arrowhead longitudinal axis and shaft longitudinal axis to provide a properly balanced arrow about said axes.

2. An arrow according to claim 1 wherein, said alignment member includes a washer element and said cam means comprises opposite faces on said washer element disposed in planes non-parallel to one another.

3. An arrow according to claim 2 wherein, said washer element comprises a radially split lock washer.

4. An arrow according to claim 2 including, a knurled external periphery on said washer element.

5. An arrow according to claim 1 including, abutment means on said stud intermediate said shaft forward portion and arrowhead blade, said shaft connection means comprising a threaded bore whereby, tightening of said stud within said bore captively engages said alignment member with said abutment means bearing upon said cam means.

6. An arrow according to claim 1 wherein, said connection means comprises an insert having a threaded bore axially disposed within said shaft forward portion.

7. An arrow according to claim 1 wherein, said shaft comprises tubular stock and said connection means comprises an insert having a threaded bore axially disposed within said shaft foward portion.

8. An arrow according to claim 1 wherein, said shaft is of solid stock and said connection means comprises a threaded bore.

9. An arrow according to claim 1 including, reference means on said alignment member depicting the angular position thereof relative said arrow shaft.

10. An arrow according to claim 9 wherein, said reference means includes a radially projecting tab on said alignment member.

11. An arrow according to claim 9 wherein, said reference means includes indicia on said alignment.

12. An arrow according to claim 9 including, additional reference means adjacent said shaft forward portion.

13. An arrow according to claim 12 wherein, said additional reference means comprises indicia.

* * * * *